US006823844B2

(12) United States Patent
Steinbrenner et al.

(10) Patent No.: US 6,823,844 B2
(45) Date of Patent: Nov. 30, 2004

(54) METHOD FOR THE OPERATION OF A FUEL METERING SYSTEM ON A DIRECT INJECTION INTERNAL COMBUSTION ENGINE

(75) Inventors: Ulrich Steinbrenner, Stuttgart (DE); Klaus Joos, Waldheim (DE); Thomas Frenz, Noerdlingen (DE)

(73) Assignee: Robert Bosch GmbH, Stuttgart (DE)

( * ) Notice: Subject to any disclaimer, the term of this patent is extended or adjusted under 35 U.S.C. 154(b) by 60 days.

(21) Appl. No.: 10/030,634

(22) PCT Filed: May 8, 2001

(86) PCT No.: PCT/DE01/01720

§ 371 (c)(1),
(2), (4) Date: Jun. 4, 2002

(87) PCT Pub. No.: WO01/86139

PCT Pub. Date: Nov. 15, 2001

(65) Prior Publication Data

US 2002/0162536 A1 Nov. 7, 2002

(30) Foreign Application Priority Data

May 11, 2000 (DE) ..... 100 23 033

(51) Int. Cl.[7] ..... F02M 37/04
(52) U.S. Cl. ..... 123/446; 123/456
(58) Field of Search ..... 123/446, 456, 123/497, 500, 501, 498, 499, 506

(56) References Cited

U.S. PATENT DOCUMENTS 5,133,645 A 7/1992 Crowley et al.
5,230,613 A * 7/1993 Hilsbos et al. ..... 417/439
5,404,855 A * 4/1995 Yen et al. ..... 123/446
5,433,182 A 7/1995 Augustin et al.
5,676,114 A * 10/1997 Tarr et al. ..... 123/446
5,697,343 A * 12/1997 Isozumi et al. ..... 123/446
6,095,118 A * 8/2000 Klinger et al. ..... 123/446
6,135,090 A * 10/2000 Kawachi et al. ..... 123/446
6,186,120 B1 * 2/2001 Guentert et al. ..... 123/459
6,253,735 B1 * 7/2001 Miyajima ..... 123/456

FOREIGN PATENT DOCUMENTS

EP 0 860 600 A 8/1998

* cited by examiner

*Primary Examiner*—Carl S. Miller
(74) *Attorney, Agent, or Firm*—Ronald E. Greigg

(57) ABSTRACT

The present invention relates to a method for operating a fuel metering system (11) of a direct-injection internal combustion engine, having a fuel supply container, at least one prefeed pump a high-pressure pump assembly having at least two high-pressure pumps for pumping fuel out of the low-pressure region into at least one high-pressure reservoir, a control unit for regulating an injection pressure prevailing in the high-pressure reservoir, and having fuel injection valves for injecting fuel out of the high-pressure reservoir into combustion chambers of the engine. In order especially in engines with large displacement and in engines with more than four cylinders to assure reliable supply of fuel to the combustion chambers, it is proposed that the fuel metering system has one fuel circuit for metering fuel into all the combustion chambers of the engine, and all the high-pressure pumps are disposed in the fuel circuit, and that all the high-pressure pumps are triggered independently of one another via a common pressure regulating circuit.

30 Claims, 4 Drawing Sheets

METHOD FOR THE OPERATION OF A FUEL METERING SYSTEM ON A DIRECT INJECTION INTERNAL COMBUSTION ENGINE

CROSS-REFERENCE TO RELATED APPLICATIONS

This application is a 35 U.S.C. 371 application of PCT/DE01/01720, filed May 8, 2001.

BACKGROUND OF THE INVENTION

1. Field of the Invention

The present invention relates to a method for operating a fuel metering system of a direct-injection internal combustion engine, having a fuel supply container, at least one prefeed pump for pumping fuel out of the fuel supply container into a low-pressure region of the fuel metering system, a high-pressure pump assembly having at least two high-pressure pumps for pumping fuel out of the low-pressure region into at least one high-pressure reservoir, a control unit for regulating an injection pressure prevailing in the high-pressure reservoir, and having fuel injection valves for injecting fuel out of the high-pressure reservoir into combustion chambers of the engine.

The invention also relates to a fuel metering system of a direct-injection internal combustion engine, having a fuel supply container, at least one prefeed pump for pumping fuel out of the fuel supply container into a low-pressure region of the fuel metering system, a high-pressure pump assembly having at least two high-pressure pumps for pumping fuel out of the low-pressure region into at least one common rail, a control unit for regulating an injection pressure prevailing in the high-pressure reservoir, and having fuel injection valves for injecting fuel out of the high-pressure reservoir into combustion chambers of the engine.

The present invention further relates to a fuel metering system of a direct-injection internal combustion engine, which includes a fuel supply container, at least one prefeed pump for pumping fuel out of the fuel supply container into a low-pressure region of the fuel metering system, a high-pressure pump assembly having at least two high-pressure pumps for pumping fuel out of the low-pressure region into at least one high-pressure reservoir, a control unit for regulating an injection pressure prevailing in the high-pressure reservoir, and fuel injection valves for injecting fuel out of the high-pressure reservoir into combustion chambers of the engine.

Finally, the invention also relates to a control unit for a direct-injection internal combustion engine of this type.

2. Description of the Prior Art

Direct-injection internal combustion engines of the type referred to at the outset, with fuel metering systems of the type referred to at the outset, are known from the prior art, for instance in the form of engines with direct gasoline injection. The fuel metering system has a prefeed pump, typically embodied as an electric fuel pump, which pumps fuel out of a fuel supply container into a low-pressure region of the fuel metering system. A high-pressure pump assembly of the fuel metering system pumps fuel out of the low-pressure region at high pressure into a high-pressure reservoir. The high-pressure reservoir is embodied for instance as the distributor strip of a common rail (CR) fuel metering system. From the high-pressure reservoir, injection valves branch off, by way of which fuel can be injected from the high-pressure reservoir into combustion chambers of the engine. The injection valves are triggered by a control unit of the engine. The control unit further has the task of regulating the injection pressure, via a pressure regulating circuit, that prevails in the high-pressure reservoir. Increasing the injection pressure can be achieved by suitable triggering of the high-pressure pump assembly, or in other words by increasing the delivery of fuel to the high-pressure reservoir. Reducing the injection pressure can be achieved by suitable triggering of a control valve that branches off from the high-pressure reservoir, that is, by increasing the fuel outflow from the high-pressure reservoir, or by reducing the pumping capacity of the high-pressure pump. The control valve is embodied for instance as a quantity control valve (in the case of one-cylinder piston-type high-pressure pumps) or as a pressure control valve (in three-cylinder radial piston high-pressure pumps).

In internal combustion engines with four cylinders or fewer, or in internal combustion engines with a relatively small displacement, the high-pressure pump assembly as a rule includes only a single high-pressure pump. The pump can be embodied as a one-cylinder piston pump, for example, or as a three-cylinder radial piston pump. With one high-pressure pump, in engines with four cylinders or fewer or in engines with a relatively small displacement, a reliable supply of the requisite fuel quantity to the combustion chambers can be assured in all the operating states of the engine.

However, it has been found that in engines with a relatively large displacement or engines with six cylinders or more, reliable fuel supply can no longer be assured with only a single high-pressure pump. It is therefore known from the prior art for a fuel metering system to be divided into two independent fuel circuits. The independence of the fuel circuits fundamentally requires that there be two high-pressure reservoirs and two pressure regulating circuits, which must be triggered by the control unit and must above all be coordinated. Each of the fuel circuits has its own high-pressure pump, which is triggered via its own pressure regulating circuit. This kind of subdivision of the fuel metering system into two fuel circuits is known from the prior art for six-cylinder engines, in which case each fuel circuit is responsible for supplying the combustion chambers of three cylinders, and for eight-cylinder engines, in which case each fuel circuit is responsible for supplying the combustion chambers of four cylinders. The proposals known from the prior art for assuring reliable fuel supply to engines of relatively large displacement or engines with six or more cylinders, however, involve relatively complicated and expensive systematic solutions.

From German Patent Disclosure DE 198 23 639 A1, a common rail (CR) fuel metering system of the type described at the outset is known, with one prefeed pump and one high-pressure pump. From German Patent Disclosure DE 195 23 283 A1, a high-pressure pump for a fuel metering system is known. The described high-pressure pump can be embodied as either a radial piston pump, with three pump pistons disposed in a star pattern, or as an axial piston pump, with two pump pistons disposed parallel to one another. In the known high-pressure pump, the individual pistons are actuated via a common cam or eccentric drive. In other words, there is a fixed mechanical coupling among the individual pump pistons, which does not allow targeted actuation of individual pump pistons. Although the known high-pressure pump has a plurality of pump pistons, nevertheless it must be considered as a single high-pressure pump.

From other fields in automotive technology, especially from the field of brake systems and active suspension systems, pump assemblies with a plurality of pump pistons are known. For instance, from German Patent DE 40 41 800 C2, a two-piston pump, embodied as an axial piston pump, of an anti-lock brake system is known, with two pump pistons disposed parallel to one another. From European Patent Disclosure EP 0 448 836 A1, a reciprocating piston pump in a vehicle brake system, for pumping fluid, is known that is embodied as a radial piston pump with two diametrically opposed pump pistons. Finally, from German Patent Disclosure DE 40 27 794 A1, a radial piston pump is known for supplying energy to the vehicle hydraulic system (anti-lock system or ABS, traction control or ASR, active suspension control). It is a common feature of all these pump assemblies that there is a fixed mechanical coupling among the individual pump pistons, and targeted actuation of individual pump pistons is not possible, so that all these pump assemblies have to be considered as single pumps.

The object of the present invention is, in a structurally simple and as inexpensive as possible a way, to assure reliable fuel supply particularly in engines with four or more cylinders or in engines of large displacement.

To attain this object, the invention proposes, on the basis of the method of the type defined at the outset, that the fuel metering system has one fuel circuit for metering fuel into all the combustion chambers of the engine, and all the high-pressure pumps are disposed in the fuel circuit, and that all the high-pressure pumps are triggered independently of one another via a common pressure regulating circuit.

SUMMARY OF THE INVENTION

According to the invention, the fuel metering system is accordingly not subdivided into a plurality of fuel circuits; instead, only one fuel circuit is provided for metering fuel to all the combustion chambers of the engine. All the high-pressure pumps of the high-pressure pump assembly are disposed in this fuel circuit. The fuel metering system of the invention preferably has two high-pressure pumps. The high-pressure pumps used can be embodied as standard pumps, such as one-cylinder piston pumps or three-cylinder radial piston pumps, of the kind known per se from the prior art. The control unit of the fuel metering system triggers all the high-pressure pumps independently of one another via one common pressure regulating circuit. Only a single high-pressure reservoir is disposed in the fuel circuit, and its injection pressure can be regulated by only a single pressure regulating circuit. As a result, the method can be achieved in an especially simple, economical way.

Also with the method of the invention, a reliable supply of fuel to the combustion chambers, especially in engines of relatively large displacement or engines with four or more cylinders, can be assured.

Because the high-pressure pumps pump into a common high-pressure reservoir, simple regulation of the injection pressure that prevails in the high-pressure reservoir is attainable with only a single pressure regulating circuit. Only in the case of the end stages for triggering the high-pressure pumps do two of them have to be provided. At the same time, in asymmetrical ignition sequences, the method of the invention avoids a complex structure of the fuel metering system.

In an advantageous refinement of the present invention, it is proposed that the high-pressure pumps are triggered parallel to one another. In other words, the high-pressure pumps are triggered in synchronized fashion and execute an intake stroke and a pumping stroke simultaneously.

Alternatively, in another advantageous refinement of the present invention, it is proposed that one or more first high-pressure pumps are triggered oppositely from one or more second high-pressure pumps. The first high-pressure pumps and the second high-pressure pumps execute the intake stroke and the pumping stroke in staggered fashion; that is, when the first high-pressure pumps are in the intake stroke, the second high-pressure pumps are in the pumping stroke; conversely, when the high-pressure pumps are in the pumping stroke, the second high-pressure pumps are in the intake stroke. The advantage of this refinement is that a marked reduction in the different pressure levels of successive injections can be attained, since the replenishment is distributed uniformly. A further advantage is the possibility of simple diagnosis of the high-pressure pumps, because the course of the injection pressure prevailing in the high-pressure reservoir is monitored.

For triggering by the control unit in a way that is economical in terms of resources, it is proposed in a preferred embodiment of the present invention that the high-pressure pumps are triggered with the same triggering time. The triggering time is accordingly calculated in the control unit only once for all the high-pressure pumps of the fuel metering system. The triggering of the individual high-pressure pumps is then effected via a switchover device, which switches over between the first high-pressure pumps and the second high-pressure pumps at the appropriate instance or at the appropriate angular position of the engine crankshaft. In this way, with the same triggering time, the first high-pressure pumps and the second high-pressure pumps can be triggered in alternation.

As a further way of attaining the object of the present invention, based on the fuel metering system of the type defined at the outset, it is proposed that the fuel metering system has one fuel circuit for metering fuel into all the combustion chambers of the engine, and all the high-pressure pumps are disposed in the fuel circuit, and that the control unit includes one pressure regulating circuit for all the high-pressure pumps, and the high-pressure pumps are triggerable independently of one another via the pressure regulating circuit.

In a preferred refinement of the present invention, it is proposed that the high-pressure pump assembly has two high-pressure pumps.

In a preferred embodiment of the present invention, it is proposed that the control unit triggers the high-pressure pumps parallel to one another. As an alternative, it is proposed that the control unit triggers one or more first high-pressure pumps oppositely from one or more second high-pressure pumps.

Advantageously, the control unit triggers the high-pressure pumps with the same triggering time.

In an advantageous refinement of the present invention, it is proposed that the engine has at least six cylinders.

In a preferred embodiment of the invention, the fuel metering system has two high-pressure reservoir regions, which communicate with one another via a pressure equalization line. By means of the pressure equalization line, the two high-pressure reservoir regions are combined into a common high-pressure reservoir.

Finally, based on the control unit of the type defined at the outset, as still another way of attaining the object of the present invention, it is proposed that the fuel metering system has one fuel circuit for metering fuel into all the combustion chambers of the engine, and all the high-pressure pumps are disposed in the fuel circuit, and that the control unit triggers all the high-pressure pumps independently of one another via a common pressure regulating circuit.

In an advantageous refinement of the present invention, it is proposed that the control unit triggers the high-pressure pumps parallel to one another. Alternatively, it is proposed that the control unit triggers one or more first high-pressure pumps oppositely from one or more second high-pressure pumps. Advantageously, the control unit triggers the high-pressure pumps with the same triggering time.

Realizing the method of the invention in the form of a control element which is provided for a control unit of a direct-injection internal combustion engine is of particular significance. A program is stored in memory in the control element that can be run on a computer, especially a microprocessor, and is suitable for performing the method of the invention. In this case, the invention is accordingly realized by a program stored in memory in the control element, so that this control element having the program is as representative of the invention as the method for whose execution the program is suited. As the control element, an electrical storage medium can in particular be used, such as a read-only memory or a flash memory.

BRIEF DESCRIPTION OF THE DRAWINGS

Further characteristics, possible applications, and advantages of the invention will become apparent from the ensuing description of exemplary embodiments of the invention, taken in conjunction with the drawings, in which FIG. 1, a schematic block circuit diagram of one exemplary embodiment of an internal combustion engine according to the invention.

DESCRIPTION OF THE PREFERRED EMBODIMENTS

Figure 1:
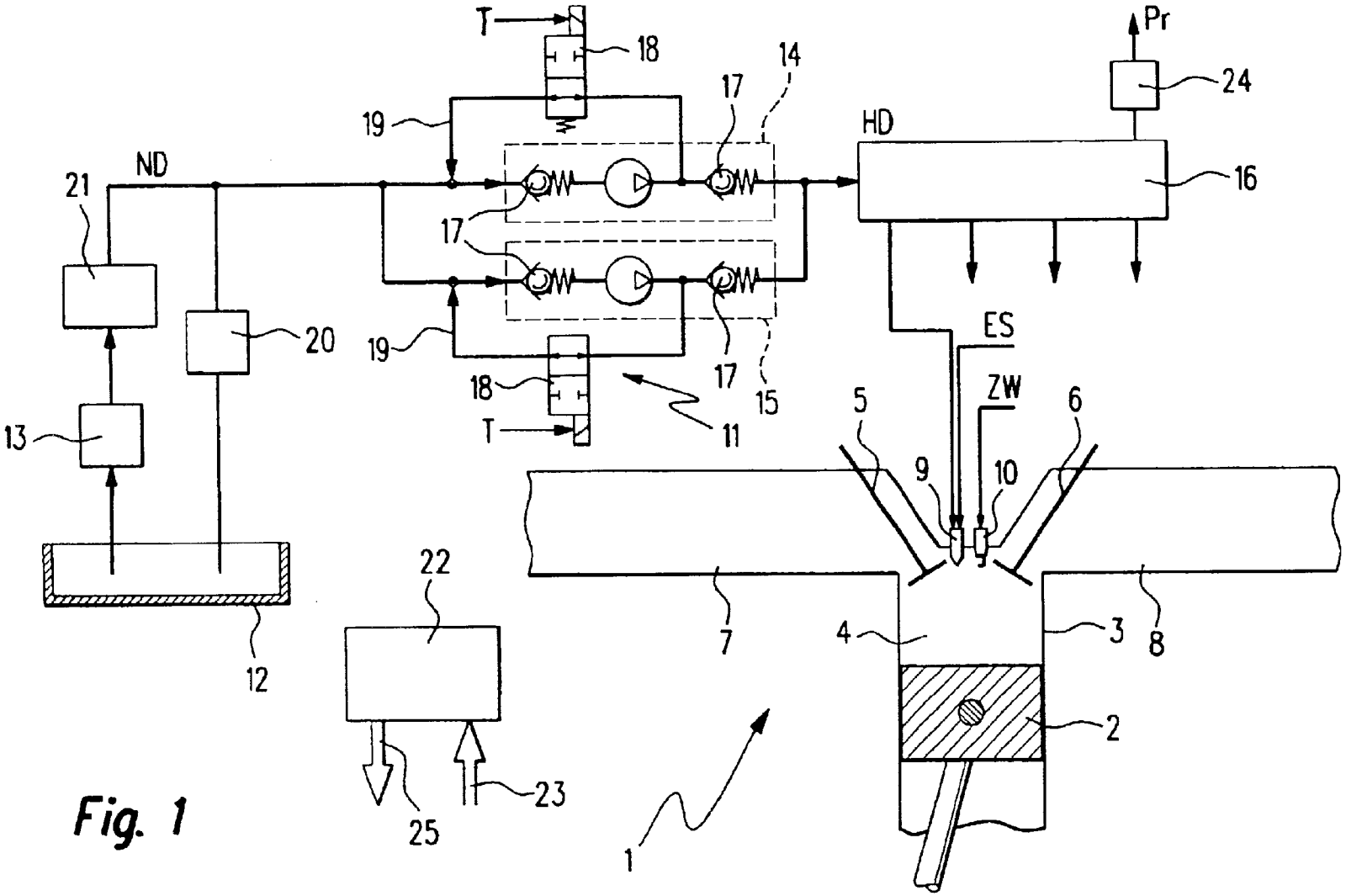

In FIG. 1, a direct-injection internal combustion engine 1 of a motor vehicle is shown, in which a piston 2 is capable of reciprocation in a cylinder 3. The cylinder 3 is provided with a combustion chamber 4, which is defined by the piston 2, an inlet valve 5, and an outlet valve 6, among other elements. An intake tube 7 is coupled to the inlet valve 5, and an exhaust pipe 8 is coupled to the outlet valve 6.

An injection valve 9 and a spark plug 10 protrude into the combustion chamber 4 in the region of the inlet valve 5 and the outlet valve 6. Via the injection valve 9, fuel can be injected into the combustion chamber 4. With the spark plug 10, the fuel in the combustion chamber 4 can be ignited.

The piston 2 is set into a reciprocating motion by the combustion of the fuel in the combustion chamber 4; this motion is transmitted to a crankshaft, not shown, and exerts a torque on it.

The engine 1 has a fuel metering system 11, by which the fuel to be injected into the combustion chamber 4 via the injection valve 9 is metered. The fuel metering system 11 has a fuel supply container 12, from which, by a prefeed pump 13 embodied as an electric fuel pump, fuel is pumped into a low-pressure region ND of the fuel metering system 11. A high-pressure pump assembly, comprising two high-pressure pumps 14 and 15, pumps fuel out of the low-pressure region ND into a high-pressure reservoir 16. The high-pressure pumps 14, 15 are embodied as one-cylinder high-pressure pumps, each with two check valves 17 and one quantity control valve 18. By means of the quantity control valves 18, a quantity control line 19 can be opened and closed. When a quantity control line is open, the aspirated fuel is forced to flow back into the low-pressure circuit instead of being pumped into the high-pressure circuit. The quantity control valves 18 are triggered by means of trigger signals T. Alternatively, the high-pressure pumps 14, 15 can also be embodied as three-cylinder radial piston pumps. What is decisive is that standard high-pressure pumps, rather than complicated and expensive special products, can be used as the high-pressure pumps 14, 15.

The high-pressure reservoir 16 is embodied as a storage strip of a common rail (CR) fuel metering system. A pressure sensor is disposed on the high-pressure reservoir 16; it detects the injection pressure prevailing in the high-pressure reservoir 16 and generates a corresponding output signal $P_r$. From the high-pressure reservoir 16, a plurality of injection valves 9—in the present case, four of them—branch off, by way of which fuel is injected into the combustion chambers 4 of the cylinders 3 of the engine 1. For injection of fuel, the injection valves 9 are triggered by a suitable trigger signal ES. The spark plug 10 is triggered by a trigger signal ZW.

To keep the pressure in the low-pressure region ND of the fuel metering system 11 at a predeterminable value, a low-pressure regulator 20 is disposed in the low-pressure region ND; by way of this regulator, fuel can flow back out of the low-pressure region ND into the fuel supply container 12, if the pressure in the low-pressure region ND exceeds a predeterminable value. A filter 21 is disposed between the prefeed pump 13 and the high-pressure pumps 14, 15.

A control unit 22 is acted upon by input signals 23, which represent operating variables of the engine 1 that are measured by means of sensors. For example, the control unit 22 communicates with an air flow rate sensor, a lambda sensor, an rpm sensor, or a pressure sensor 24, disposed in the high-pressure region HD, preferably in the high-pressure reservoir 16, and the like. The control unit 22 generates output signals 25, with which the performance of the engine 1 can be varied by way of actuators. For instance, the control unit 22 is connected to the injection valve 9 (control signal ES), the spark plug 10 (control signal ZW), the quantity control valves 18 (control signal T), a throttle valve disposed in the intake tube 7, and the like and generates the signals required for triggering them.

Among other purposes, the control unit 22 is provided for controlling and/or regulating the operating variables of the engine 1. For instance, the fuel mass injected by the injection valve 9 into the combustion chamber 4 is controlled and/or regulated by the control unit 22 in particular for the sake of lower fuel consumption and/or low pollutant emissions. To that end, the control unit 22 is provided with a microprocessor in which a program suitable for performing the aforementioned control and/or regulation is stored in a control element, in particular a read-only memory or a flash memory. A program suitable for executing the method of the invention is also stored in memory in the control element.

The engine 1 of FIG. 1 can be operated in many operating modes. For instance, it is possible to operate the engine 1 in a homogeneous mode, a stratified mode, a homogeneous lean mode, and so forth. It is possible to switch among the aforementioned operating modes of the engine. Such switchovers are performed by the control unit 22.

The fuel metering system 11 shown in FIG. 1 is distinguished in particular in having only a single fuel circuit for metering fuel and to all the combustion chambers 4 of the engine 1.

Both high-pressure pumps 14, 15 are disposed in this single fuel circuit. Both high-pressure pumps 14, 15 are triggered independently of one another by the control unit 22 via a common pressure regulating circuit. For economy of operation, in terms of resources, of the fuel metering system 11, both high-pressure pumps 14, 15 are triggered with the same triggering time signal T. The triggering time signal T is accordingly calculated once and for all in the control unit 22 for both high-pressure pumps 14, 15.

FIG. 1 shows the fuel metering system 11 of the invention for an internal combustion engine 1 with four cylinders 3. By means of the fuel metering system 11 of the invention, a reliable supply of fuel to the combustion chambers 4 is assured, even in engines 1 that have more than four cylinders 3 and/or that have a large displacement.

Figure 2:
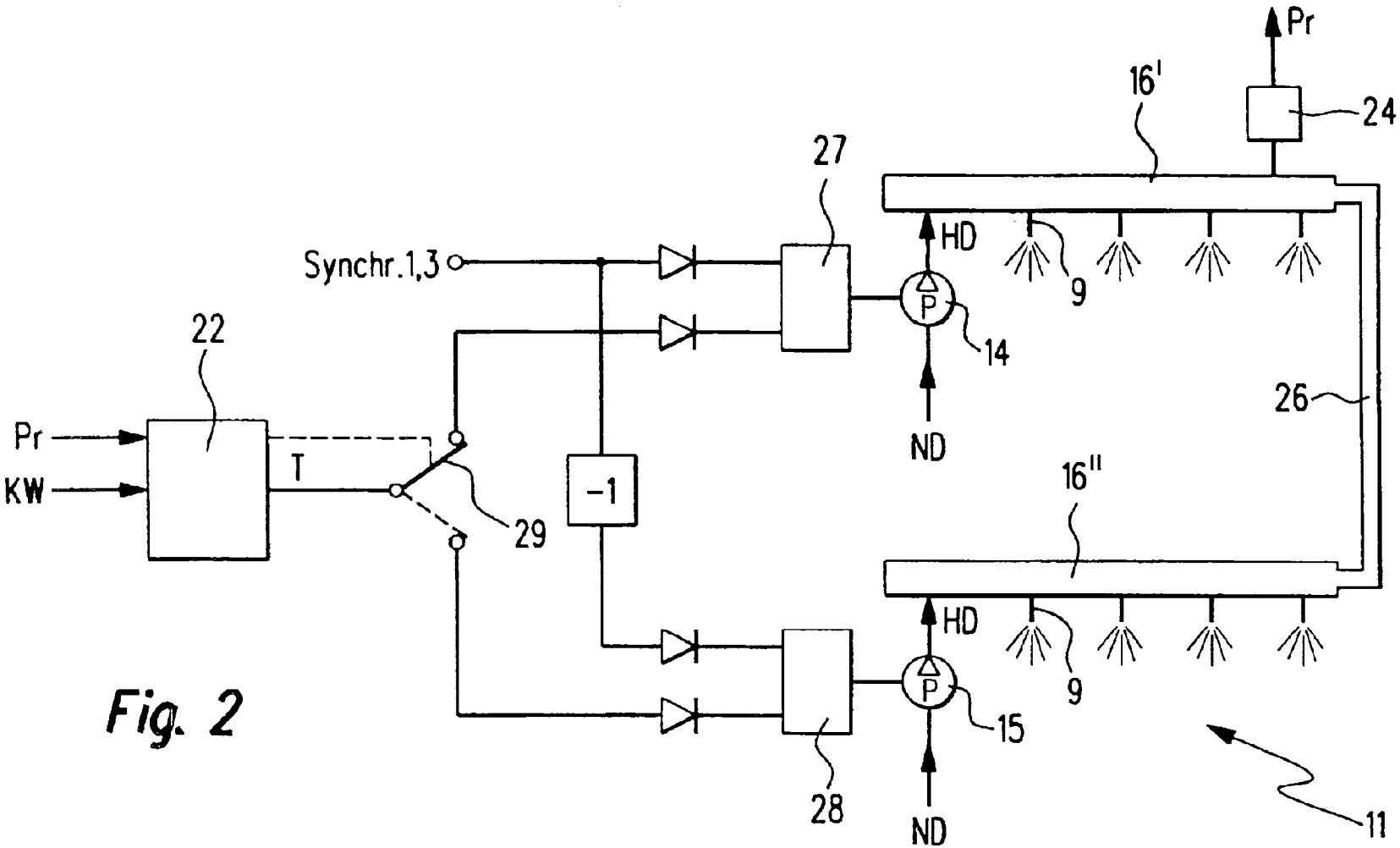
FIG. 2, a schematic block circuit diagram of a first exemplary embodiment of a fuel metering system according to the invention.

In FIG. 2, a fuel metering system 11 of the invention is shown, taking as an example an eight-cylinder internal combustion engine. In the eight-cylinder engine 1, the high-pressure reservoir 16 includes a left-hand bank 16' and a right-hand bank 16". The two banks 16', 16" communicate with one another via a pressure equalization line 26, so that the same injection pressure prevails in both banks 16', 16", and the banks 16', 16" can be considered as a single common high-pressure reservoir 16. Four injection valves 9 branch off from each bank 16', 16", and by way of these valves fuel can be injected into the combustion chambers 4 of the engine 1. Each bank 16', 16" is supplied with fuel from the low-pressure region ND by its own high-pressure pump 14; 15. Each high-pressure pump 14; 15 is assigned its own end stage 27; 28.

The control unit 22 ascertains the triggering time T only once for both high-pressure pumps 14, 15. The distribution of the control signal T to the end stages 27, 28 of the two high-pressure pumps 14, 15 is accomplished via a switch 29. The switch 29 is switched over in accordance with a synchronizing pattern for the eight-cylinder engine 1 every 180°0 of the crankshaft KW. If an adjustable camshaft is used as the drive mechanism for the high-pressure pumps 14, 15, then the synchronizing pattern should be derived accordingly, based on the adjustable camshaft.

Because of the limited steepness of the cams for driving the high-pressure pumps 14, 15, in single-cylinder high-pressure pumps for an eight-cylinder engine 1, a camshaft with four cams per revolution cannot be used. At the same time, the fuel circuits in an eight-cylinder engine 1 cannot be disposed in accordance with the mechanical arrangement shown (left-hand bank 16', right-hand bank 16"), since the ignition sequence or injection sequence is not symmetrical; that is, it does not shift in alternation from the left-hand bank 16' to the right-hand bank 16". The fuel metering system according to the invention provides a solution to this problem.

Figure 3:
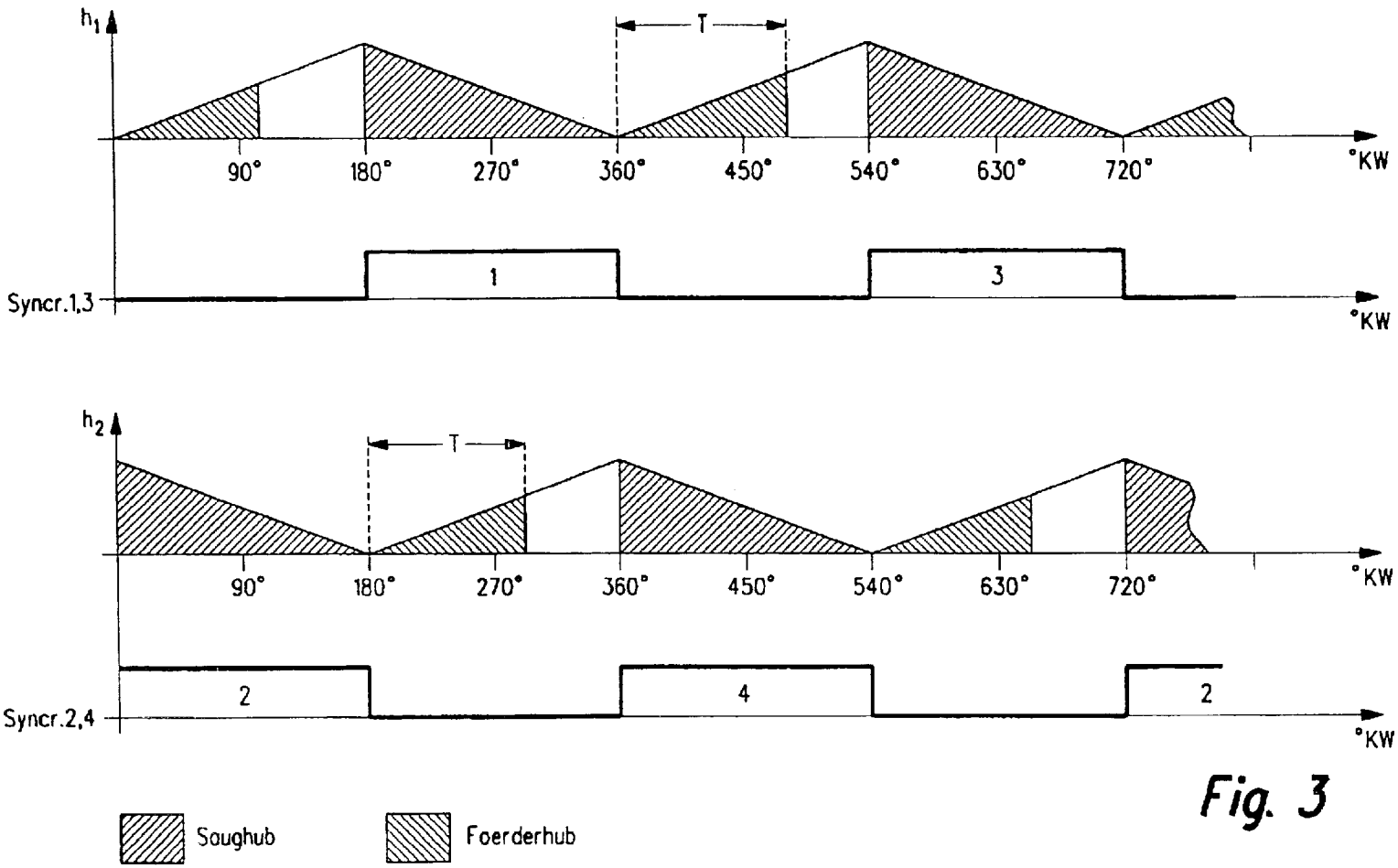
FIG. 3, a graph to illustrate one exemplary embodiment of a method of the invention for operating the fuel metering system of FIG. 2.

FIG. 3 shows a triggering of the high-pressure pumps 14, 15 of the fuel metering system 11 of FIG. 2 in accordance with a preferred embodiment. In the upper half of FIG. 3, the stroke $h_1$ of the high-pressure pump 14 is shown, and in the lower part, the stroke $h_2$ of the high-pressure pump 15 is shown. It is clearly seen that the two high-pressure pumps 14, 15 are triggered oppositely from one another. It can also be learned from FIG. 3 when the pump pistons of the high-pressure pumps 14, 15 execute an intake stroke, or when they pump fuel into the high-pressure reservoir 16 in a pumping stroke.

Figure 4:
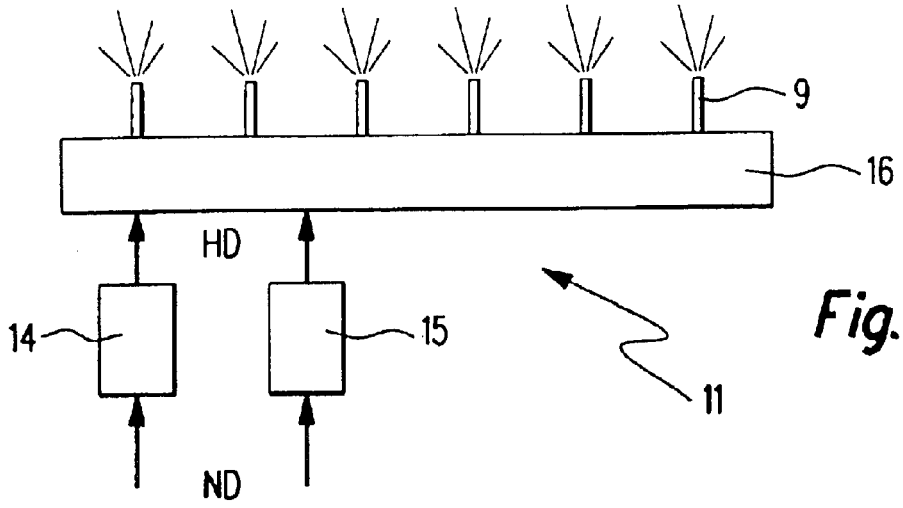
FIG. 4, a schematic block circuit diagram of a detail of a second exemplary embodiment of a fuel metering system according to the invention.

In FIG. 4, a fuel metering system 11 of the invention for an internal combustion engine with six cylinders 3 is shown in detail. In this exemplary embodiment, six injection valves 9 discharge from the high-pressure reservoir 16, and by way of them fuel can be injected into the combustion chambers 4 of the individual cylinders 3. As in the fuel metering system 11 of FIG. 1, once again fuel is pumped by two high-pressure pumps 14, 15 from the low-pressure region ND of the fuel metering system 11 into the high-pressure reservoir 16. The fuel metering system 11 shown in FIG. 4 again has only a single fuel circuit for metering fuel into all the combustion chambers 4 of the engine 1. Both high-pressure pumps 14, 15 are disposed in this one fuel circuit. Both high-pressure pumps 14, 15 are triggered independently of one another via a single common pressure regulating circuit (see FIG. 2).

Figure 5:
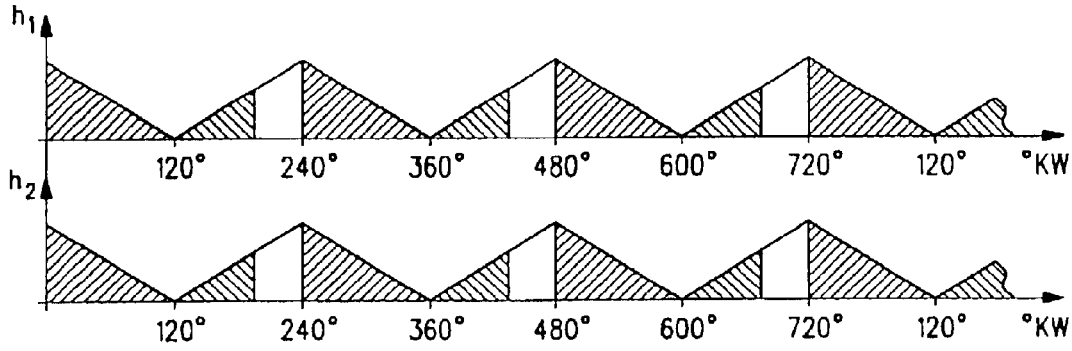
FIG. 5, a graph to illustrate a second exemplary embodiment of a method of the invention for operating the fuel metering system of FIG. 4.
Figure 6:
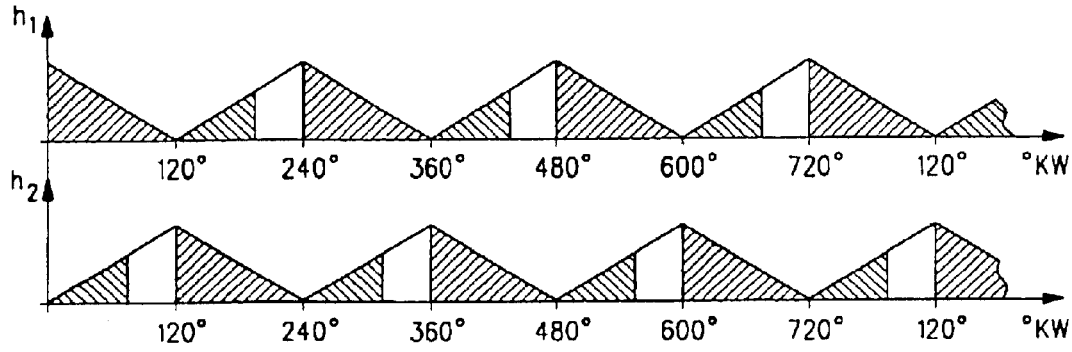
FIG. 6, a graph to illustrate a third exemplary embodiment of a method of the invention for operating the fuel metering system of FIG. 4.

In FIGS. 5 and 6, two different possible ways of triggering the high-pressure pumps 14, 15 of the fuel metering system 11 of FIG. 4 are shown. In the exemplary embodiment shown in FIG. 5, the high-pressure pumps 14, 15 are triggered parallel to one another. In the exemplary embodiment of FIG. 6, the high-pressure pumps 14, 15 are conversely—similarly to the exemplary embodiment of FIG. 3—triggered oppositely from one another. In FIGS. 5 and 6, the intake stroke and pumping stroke are shown as in the exemplary embodiment of FIG. 3.

The foregoing relates to preferred exemplary embodiments of the invention, it being understood that other variants and embodiments thereof are possible within the spirit and scope of the invention, the latter being defined by the appended claims.

We claim:

1. A method for operating a fuel metering system (11) of a direct-injection internal combustion engine (1) in which the fuel metering system has a fuel supply container (12), at least one prefeed pump (13) for pumping fuel out of the fuel supply container (12) into a low-pressure region (ND) of the fuel metering system (11), a high-pressure pump assembly having at least two high-pressure pumps (14, 15) for pumping fuel out of the low-pressure region (ND) into at least one high-pressure reservoir (16; 16', 16"), a control unit (22) for regulating an injection pressure ($P_r$) prevailing in the high-pressure reservoir (16; 16', 16"), and fuel injection valves (9) for injecting fuel out of the high-pressure reservoir (16; 16', 16") into combustion chambers (4) of the engine (1), the method comprising providing the fuel metering system (11) with one fuel circuit for metering fuel into all the combustion chambers (4) of the engine (1), connecting all the high-pressure pumps (14, 15) in the fuel circuit, and triggering all the high-pressure pumps (14, 15) independently of one another via a common pressure regulating circuit, wherein the high-pressure pumps (14, 15) are triggered with the same triggering time signal (T).

2. The method of claim 1, wherein the high-pressure pumps (14, 15) are triggered parallel to one another.

3. The method of claim 1, wherein one or more first high-pressure pumps (14) are triggered oppositely from one or more second high-pressure pumps (15).

4. A fuel metering system (11) of a direct-injection internal combustion engine (1), comprising a fuel supply container (12), at least one prefeed pump (13) for pumping fuel out of the fuel supply container (12) into a low-pressure region (ND) of the fuel metering system (11), a high-pressure pump assembly having at least two high-pressure pumps (14,15) for pumping fuel out of the low-pressure region (ND) into at least one high-pressure reservoir (16; 16', 16"), a control unit (22) for regulating an injection pressure ($P_r$) prevailing in the high-pressure reservoir (16; 16', 16"), and fuel injection valves (9) for injecting fuel out of the high-pressure reservoir (16; 16', 16") into combustion chambers (4) of the engine (1), the fuel metering system (11) having one fuel circuit for metering fuel into all the combustion chambers (4) of the engine (1), all the high-pressure pumps (14, 15) being disposed in the fuel circuit, and the control unit (22) including one pressure regulating circuit for all the high-pressure pumps (14, 15), the high-pressure pumps (14, 15) being triggerable independently of one another via the pressure regulating circuit, wherein the high-pressure pumps (14, 15) are triggered with the same triggering time signal (T).

5. The fuel metering system (11) of claim 4, wherein the high-pressure pump assembly has two high-pressure pumps (14, 15).

6. The fuel metering system (11) of claim 4, wherein the control unit (22) triggers the high-pressure pumps (14, 15) parallel to one another.

7. The fuel metering system (11) of claim 5, wherein the control unit (22) triggers the high-pressure pumps (14, 15) parallel to one another.

8. The fuel metering system (11) of claim 4, wherein the control unit (22) triggers one or more first high-pressure pumps (14) oppositely from one or more second high-pressure pumps (15).

9. The fuel metering system (11) of claim 5, wherein the control unit (22) triggers one or more first high-pressure pumps (14) oppositely from one or more second high-pressure pumps (15).

10. The fuel metering system (11) of claim 4, wherein the control unit (22) triggers the high-pressure pumps (14, 15) with the same triggering time signal (T).

11. The fuel metering system (11) of claim 5, wherein the control unit (22) triggers the high-pressure pumps (14, 15) with the same triggering time signal (T).

12. The fuel metering system (11) of claim 6, wherein the control unit (22) triggers the high-pressure pumps (14, 15) with the same triggering time signal (T).

13. The fuel metering system (11) of claim 7, wherein the control unit (22) triggers the high-pressure pumps (14, 15) with the same triggering time signal (T).

14. The fuel metering system (11) of claim 8, wherein the control unit (22) triggers the high-pressure pumps (14, 15) with the same triggering time signal (T).

15. The fuel metering system (11) of claim 9, wherein the control unit (22) triggers the high-pressure pumps (14, 15) with the same triggering time signal (T).

16. In a fuel metering system (11) of a direct-injection internal combustion engine (1), including a fuel supply container (12), at least one prefeed pump (13) for pumping fuel out of the fuel supply container (12) into a low-pressure region (ND) of the fuel metering system (11), a high-pressure pump assembly having at least two high-pressure pumps (14,15) for pumping fuel out of the low-pressure region (ND) into at least one high-pressure reservoir (16; 16', 16"), a control unit (22) for regulating an injection pressure ($P_r$) prevailing in the high-pressure reservoir (16; 16', 16"), and fuel injection valves (9) for injecting fuel out of the high-pressure reservoir (16; 16', 16") into combustion chambers (4) of the engine (1), the improvement wherein the fuel metering system (11) comprising one fuel circuit for metering fuel into all the combustion chambers (4) of the engine (1), all the high-pressure pumps (14, 15) being disposed in the fuel circuit, and the control unit (22) including one pressure regulating circuit for all the high-pressure pumps (14, 15), the high-pressure pumps (14, 15) being triggerable independently of one another via the pressure regulating circuit, wherein the high-pressure pumps (14, 15) are triggered with the same triggering time signal (T).

17. The fuel metering system (11) of claim 16, wherein the high-pressure pump assembly has two high-pressure pumps (14, 15).

18. The fuel metering system (11) of claim 16, wherein the control unit (22) triggers the high-pressure pumps (14, 15) parallel to one another.

19. The fuel metering system (11) of claim 17, wherein the control unit (22) triggers the high-pressure pumps (14, 15) parallel to one another.

20. The fuel metering system (11) of claim 16, wherein the control unit (22) triggers one or more first high-pressure pumps (14) oppositely from one or more second high-pressure pumps (15).

21. The fuel metering system (11) of claim 17, wherein the control unit (22) triggers one or more first high-pressure pumps (14) oppositely from one or more second high-pressure pumps (15).

22. The engine (1) of claim 16, characterized in that the engine (1) has at least six cylinders (3).

23. The engine (1) of claim 16, wherein the fuel metering system (11) has two high-pressure reservoir regions (16', 16"), which communicate with one another via a pressure equalization line (26).

24. In a control unit (22) for a fuel metering system (11) of a direct-injection internal combustion engine (1), which includes a fuel supply container (12), at least one prefeed pump (13) for pumping fuel out of the fuel supply container (12) into a low-pressure region (ND) of the fuel metering system (11), a high-pressure pump assembly having at least two high-pressure pumps (14, 15) for pumping fuel out of the low-pressure region (ND) into at least one common rail (16; 16', 16"), the control unit (22) for regulating an injection pressure ($P_r$) prevailing in the high-pressure reservoir (16; 16', 16"), and fuel injection valves (9) for injecting fuel out of the high-pressure reservoir (16; 16', 16") into combustion chambers (4) of the engine (1), the improvement wherein the fuel metering system (11) has one fuel circuit for metering fuel into all the combustion chambers (4) of the engine (1), and all the high-pressure pumps (14, 15) are disposed in the fuel circuit, and that the control unit (22) triggers all the high-pressure pumps (14, 15) independently of one another via a common pressure regulating circuit, wherein the high-pressure pumps (14, 15) are triggered with the same triggering time signal (T).

25. The control unit (22) of claim 24, wherein the control unit (22) triggers the high-pressure pumps (14, 15) parallel to one another.

26. The control unit (22) of claim 24, wherein the control unit (22) triggers one or more first high-pressure pumps (14) oppositely from one or more second high-pressure pumps (15).

27. The control unit (22) of claim 24, wherein the control unit (22) triggers the high-pressure pumps (14, 15) with the same triggering time signal (T).

28. The control unit (22) of claim 25, wherein the control unit (22) triggers the high-pressure pumps (14, 15) with the same triggering time signal.

29. The control unit (22) of claim 26, wherein the control unit (22) triggers the high-pressure pumps (14, 15) with the same triggering time signal (T).

30. A control element, in particular a read-only memory (ROM) or flash memory, for a control unit (22) of a direct-injection internal combustion engine (1), in which a program is stored in memory that is capable of being run on a computer, in particular a microprocessor, and is suitable for performing a method of claim 1.

* * * * *